US006817058B1

(12) United States Patent
Harrelson, II

(10) Patent No.: US 6,817,058 B1
(45) Date of Patent: Nov. 16, 2004

(54) CEILING MOUNTED VACUUM SYSTEM

(75) Inventor: Clyde W. Harrelson, II, Burgaw, NC (US)

(73) Assignee: Vacs America, Inc., Burgaw, NC (US)

( * ) Notice: Subject to any disclaimer, the term of this patent is extended or adjusted under 35 U.S.C. 154(b) by 314 days.

(21) Appl. No.: 10/094,052

(22) Filed: Mar. 8, 2002

(51) Int. Cl.[7] ..... A47L 5/38
(52) U.S. Cl. ..... 15/315; 15/314; 15/301
(58) Field of Search ..... 15/301, 315, 314

(56) References Cited

U.S. PATENT DOCUMENTS

| | | | | | |
|---|---|---|---|---|---|
| 2,641,790 | A | | 6/1953 | Coult | |
| 3,353,996 | A | * | 11/1967 | Hamrick | 15/315 |
| 3,464,859 | A | * | 9/1969 | Hamrick | 15/315 |
| 3,520,725 | A | * | 7/1970 | Hamrick | 15/315 |
| 3,568,240 | A | * | 3/1971 | Hamrick | 15/315 |
| 3,958,297 | A | * | 5/1976 | Hukuba et al. | 15/315 |
| 3,977,037 | A | * | 8/1976 | Miyake et al. | 15/315 |
| 4,246,675 | A | * | 1/1981 | Costanzo | 15/315 |
| 5,119,843 | A | * | 6/1992 | Keenan | 15/315 |
| 5,402,551 | A | * | 4/1995 | Workhoven et al. | 15/316 |
| 5,430,978 | A | | 7/1995 | Kohler | |
| 5,481,780 | A | | 1/1996 | Daneshvar | |
| 5,740,581 | A | * | 4/1998 | Harrelson, II | 15/314 |
| 5,740,582 | A | * | 4/1998 | Harrelson, II | 15/315 |
| 6,120,615 | A | | 9/2000 | Fletcher | |
| 6,143,996 | A | | 11/2000 | Skanda | |

* cited by examiner

*Primary Examiner*—Theresa T. Snider
(74) *Attorney, Agent, or Firm*—MacCord Mason PLLC

(57) ABSTRACT

A self-contained vacuum system attachable to the ceiling of a building is described. The system includes a housing having a hose storage compartment and a vacuum source compartment; a vacuum hose extendable between a retracted position in the hose storage compartment, and an extended position extending from the hose storage compartment; a reversible drive mechanism within the housing to move the hose between retracted and extended positions; a positioning mechanism to lower and raise the housing; a control device in the form of a control handle with switches, connected to the distal end of the hose and a vacuum source mounted in the vacuum source compartment, the hose having an inner end communicating with a debris collector.

25 Claims, 7 Drawing Sheets

CEILING MOUNTED VACUUM SYSTEM

BACKGROUND OF THE INVENTION (1) Field of the Invention

The present invention relates generally to a vacuum system, especially to a vacuum system of the type used in homes. The invention particularly relates to a ceiling mounted vacuum housing for storing a vacuum hose when not in use including a mechanism for lowering the housing from the ceiling for providing access to maintainable parts, and a hose drive mechanism for deploying the hose from the housing.

(2) Description of the Prior Art

Vacuum systems are comprised of a suction assembly that includes a motorized suction fan and a dust collector, and an elongated hose extending from the suction assembly. The hose, which is cylindrical and flexible, normally terminates in a handle at its distal end to which accessories may be attached. In certain embodiments, known as portable vacuum cleaners, the suction assembly is wheeled so that the operator can pull it from place to place. In order to avoid the difficulty and inconvenience of moving the suction assembly, central vacuum systems have been developed.

Generally, these central vacuum systems are comprised of a permanently located suction assembly, at least one vacuum hose outlet located near the cleaning area, and a conduit connecting the assembly to the outlet. A flexible hose having a connection end and a distal end is releasibly attached at its connection end to the outlet when the surrounding area is to be vacuumed. Electrical wiring normally extends from the suction assembly to the outlet and connects with other wiring extending through the hose to a control means in a handle at the distal end of the hose, completing an electrical circuit.

Central vacuum systems have gained wide popularity and acceptance, particularly in homes. However one continuing annoyance is the need to store the vacuum hose when the system is not being used. Often, the problem is addressed by simply stuffing the hose into an area such as a coat closet; such solutions are either inconvenient or unsightly.

Various means have been suggested by the prior art to address this problem. For example, the following patents describe central vacuum systems in which the hose is inserted into the conduit joining the suction assembly and the outlet when the hose is not in use:

| | |
|---|---|
| 3,353,996 | Hamrick |
| 3,464,859 | Hamrick |
| 3,520,725 | Hamrick |
| 3,568,240 | Hamrick |
| 5,430,978 | Kohler |
| 5,481,780 | Daneshvar |
| 6,143,996 | Skanda |

The following patents describe devices including a powered mechanism to store the hose:

| | |
|---|---|
| 4,246,675 | Costanzo |
| 5,119,843 | Keerian |
| 5,402,551 | Workhoven et al |

U.S. Pat. No. 2,641,790 to Coult discloses a vacuum hair removal system for barbershops in which a vacuum hose storage body is mounted to the ceiling of a barbershop. An access section forming a nozzle hangs down from the hose storage body. A spring returns the hose to the storage body whenever the hose is not in use.

U.S. Pat. No. 6,120,615 to Fletcher discloses a central vacuum system having a flexible hose extending from a vacuum unit into an attic space in a structure. The flexible hose passes into a living space of the structure through a ceiling orifice. A motorized retractor mechanism located near the ceiling orifice delivers the hose to the attic space for storage.

U.S. Pat. No. 3,958,297 to Hukuba et al describes a vacuum cleaner comprised of a cabinet having a suction assembly housed in a first compartment and a second compartment for housing a retractable hose. A motorized drive mechanism comprised of a pair of interlocked rollers on opposite sides of the hose is used to extend and retract the hose from the compartment.

U.S. Pat. No. 3,977,037 to Miyake et al discloses a similar structure in which a vacuum hose along with a suction assembly is housed in a piece of furniture. The hose is withdrawn from and retracted into, the piece of furniture by a drive roll engaging the surface of the hose. The drive roll is covered by a cylindrically shaped elastic layer that is axially splined to provide a series of radially inwardly recessed grooves spaced at intervals equal to the spacing of adjacent convolutions on spiral ribs of the hose.

The inventor of the present invention has two patents pertaining to vacuum systems. U.S. Pat. No. 5,740,581 to Harrelson discloses a vacuum system mountable between adjacent studs of a wall inside a residential home for vacuum cleaning the living areas of the home. U.S. Pat. No. 5,740,582 to Harrelson discloses a vacuum hose storage system that includes a hose drive mechanism for retracting and extending a vacuum hose to and from a hose storage compartment.

While certain of the above systems provide some improvement over merely dumping the hose in a closet or other area when not in use, one problem still has not been addressed in an economical and practical manner. Certain areas within a home or building are not easily cleaned with prior art vacuum systems.

A good example of such an area is a residential garage. The typical garage is a very cluttered place. It usually shelters one or two cars along with lawnmowers and other yard tools such as rakes and shovels. Beyond this floor space clutter, there is usually clutter against the walls of the garage. For example, it is not unusual to find hot water heaters, storage cabinets, workbenches and other items stacked alongside the walls. Such clutter makes using a central vacuum cleaner or portable wheeled vacuum cleaner unwieldy and impractical. The problem lies in the fact that the prior art vacuum systems are designed to clean uncluttered living spaces and these systems either have relatively long vacuum hoses that would tend to snag on clutter or these systems have shorter hoses and are portable wheeled systems that are impractical to maneuver in a cluttered environment such as a garage. What is needed is a vacuum system that is easy to install, easy to access, easy to maintain and functional in a highly cluttered environment such as a garage. Unfortunately, the previous patented inventions belonging to the present inventor also fail to meet this need alone or in combination with the prior art for much the same reasons including the added difficulty of accessing a wall mounted system that would naturally become blocked by car bodies, and the other mentioned clutter. A self-contained vacuum system that overcomes the above problems would be of considerable advantage and convenience to the homeowner.

SUMMARY OF THE INVENTION

The present invention is directed to a self-contained vacuum system that overcomes problems associated with vacuum cleaner operation in a cluttered environment by providing overhead access to the system. In particular, the vacuum system of the present invention includes a housing that can be mounted to the ceiling of a building, such as the ceiling of a residential garage, and a positioning means for lowering the housing of the vacuum system to within reach of the user. Also provided is a reversible drive mechanism for withdrawing a hose from, and returning a hose to the housing. The vacuum system includes a suction assembly, and a flexible vacuum hose. The suction assembly comprised of a motorized suction fan, a filter, and a dust collector, may be one of several types commercially available, and need not be described in detail. The hose is also of a commercially available construction, and is essentially a flexible tube that may be reinforced with a wire spiral about its outer surface. Electrical wiring may also extend through the hose from one end to the other, so that the vacuum system electrical circuitry can include an array of switches on the handle or nozzle at the distal end of the hose.

The housing of the present invention is an enclosure with an interior cavity. For example, the housing could be of cubical configuration, with spaced vertical sidewalls, a rear joining the sidewalls, a top wall, a bottom wall, rear wall and a front wall. Sections of the walls may be hinged to form one or more access doors into the housing.

The housing is preferably divided into a forward compartment and a rearward compartment by a divider wall extending across the inside of the housing between the sidewalls connecting the top and bottom walls. Attachment points are positioned on the outside of the storage compartment either along the sidewalls or alternately along the top wall such that the vacuum system can be mounted to hooks or brackets fastened to the ceiling of a structure. In the preferred embodiment, a motorized pulley system connects the vacuum system housing to hooks or brackets fastened to the ceiling of a structure. The motorized pulley system of this configuration allows the entire vacuum system to be lowered on command of an electrical switch situated on the handle or nozzle connected to the distal end of the vacuum hose. The handle and distal end of the vacuum hose hang external the housing to within reach of the user.

Alternately, with another embodiment the front of the housing is permanently mounted to ceiling of a structure by way of a hinge and only the rearward compartment of the vacuum system housing a replaceable filter bag, accessories and other user maintainable parts is accessible in the lowered position. A motorized pulley system raises and lowers the housing upon command of a switch located on the handle or nozzle on the distal end of the vacuum hose.

As noted above, the housing preferably includes a forward compartment and a rearward compartment, with the compartments being separated by a divider wall. In this configuration the forward compartment houses the retracted vacuum hose. The distal end of the vacuum hose along with the handle or nozzle hangs downwardly from the forward compartment through an orifice that leads external the forward storage compartment.

The rearward compartment houses a suction device also referred to as the vacuum source. An orifice through the divider wall connecting the forward and rearward compartments allows the proximal end of the vacuum hose to connect to the suction device.

The rearward compartment also houses a debris collector used to collect the dirt, dust and debris "vacuumed up" by the vacuum system. Typically the debris collector is a user maintainable canister or replaceable filter bag that needs to be dumped and/or replaced periodically by the user. As a result, access to the debris collector is achieved by lowering the vacuum system to a lowered position that is a predetermined distance below the ceiling of the building, putting a debris collector access door within reach of the user. Optionally, the vacuum system may house tools and other vacuum accessories such as upholstery nozzles, edge nozzles and the like that are accessible with the housing in the lowered position.

The housing also includes a powered, hose drive assembly to withdraw a hose from the hose storage compartment, and to return the hose to the compartment after use. Preferably the assembly is contained within a hose storage compartment.

In one embodiment of the ceiling mounted vacuum system a positioning means for raising and lowering the housing comprises a plurality of pulleys, preferably one for each outside corner of the housing. Generally, each pulley is fixed to an attachment point near each corner. The face of each pulley is substantially in a plane with the sidewalls of the housing. At least one suspension cable for each pulley drops perpendicular from hooks mounted into the ceiling of a structure. Preferably, all of the suspension cables are of equal length and the lower end of each cable is fastened to an attachment point located on the spool of its corresponding pulley.

Each motorized pulley shares substantially matched electrical and mechanical characteristics and are electrically wired and switched to start and stop in unison. The motorized pulley's matched physical properties combined with equal suspension cable lengths and unified start and stop functions allows the housing to be lowered and raised level with respect to roll and pitch. Whenever access to the user maintainable parts within the housing is desired, the user can reach up, grasp the downwardly hanging hose and handle and depress a switch on the handle that energizes the motorized pulleys to unwind cable thereby lowering the entire housing. Once within reach, the user may access the maintainable parts by way of access doors or hatches that are typically hinged within the walls of the housing. After the desired maintenance has been completed, the user can raise the housing back to its normal position flush with the ceiling by selecting and depressing a switch on the handle associated with lifting the housing. As soon as the top wall of the housing comes in contact with the ceiling, a current limiting protection circuit will sense the increase in load current going to the motorized pulleys and will automatically interrupt the current stopping all motorized pulleys in unison.

Another embodiment of the ceiling mounted vacuum system is available if the ceiling to which the system is mounted is low enough. Lowering the housing's rearward end while leaving the front end fixed, allows access to the rearward compartment of the housing. A hinge along the top edge of the front wall of the housing connects the forward end of the housing to the ceiling. Only one motorized pulley is needed with this hinged embodiment of the invention. Preferably, the single motorized pulley is fixed to an attachment point located near the sidewall corner of the heaviest weighted side of the rearward compartment. A single hook is fastened into the ceiling nearly directly above the spool of the motorized pulley. At least one suspension cable is fastened to the hook and drops substantially perpendicular from the ceiling. The lower end of the cable is attached to the spool of the motorized pulley. When the motorized pulley is energized the hose housing rotates about the longitudinal axis of the hinge that attaches the top edge of the front wall of the housing to the ceiling.

If for example, the user finds it necessary to change the filter bag of the vacuum system and the housing is in its normal stored position, raised flush against the ceiling, the user grasps the downwardly hanging handle and energizes the motorized pulley by depressing a switch on the vacuum hose handle activating the unwinding of suspension cable, rotating the housing downward. Once the rearward compartment of the housing has been lowered to within reach, a normally closed limit switch located on a sidewall near the hinge opens interrupting current to the circuit powering the downward rotation of the housing. From this lowered position, the user manually opens a filter bag access door hinged within a wall of the rearward compartment and replaces the filter bag in the normal manner. Next, the access door is closed and the housing is returned to the stored position by closing a switch on the vacuum handle energizing the motorized pulley to rotate opposite the previous direction winding cable back onto the pulley leading to the upward rotation of the housing. A normally closed limit switch fixed to the top of the rear wall of the housing opens interrupting current powering the motorized pulley once the housing is flush with the ceiling.

Yet another embodiment mounts the vacuum system within the ceiling of a building. In this embodiment the bottom surface of the housing is in a plane flush with the ceiling. For example, the vacuum system could be mounted in the ceiling of a hallway, similar to an attic stairs. One end of the vacuum system housing is attached to the ceiling by a hinge. The system could include a spring mechanism similar to an attic stairs to facilitate manual positioning of the system in either a lowered position or raised position. Otherwise, the positioning mechanism described in the previous embodiment could be employed. However, in this embodiment a wall switch or hand held remote control is used to activate the positioning mechanism. All embodiments of the present invention have a hose drive mechanism for extending and retracting the vacuum hose but because the vacuum hose is completely retracted into the housing or ceiling with this embodiment, a wall switch or hand held remote is provided for activating the hose drive mechanism.

The hose drive mechanism is necessary for retracting and extending the vacuum hose to and from the housing. An example of such a mechanism is disclosed in U.S. Pat. No. 5,740,582 to Harrelson, which is incorporated herein by reference. The reference describes a hose drive assembly comprised of first and second opposed hose driver rollers supported on parallel shafts with the peripheries of the roller facing each other at a predetermined distance, which is slightly less than the diameter of the hose to be manipulated, so that the roller faces snugly engage the hose surface. The periphery of each roller is concave in configuration. For example, the surface may be in the shape of an arc of a circle corresponding to the outer circumference of the hose. Together, the roll faces defining a hose-receiving nip.

In order to improve the grip on the hose, the roller may further include hose gripping projections extending from said concave faces. These projections extend radially outward and transversely across said concave faces, and may be integrally formed of the same material as the roll. For example, the entire roll may be formed of rubber or a flexible plastic material.

The drive assembly also includes a drive means for reversibly rotating the roller in opposite directions to draw the hose through the roll nip in the direction desired. The drive means may be comprised of a power source, normally an electric motor, and gears connecting the drive means to the roller. Importantly, both rollers are connected to the drive means, instead of one roller merely being an idler roll, since it has been found that gripping of the hose on the opposite side by a powered roller is necessary to achieve the force necessary to manipulate the hose.

In order to drive both rollers, each drive roller may comprise a gear having a central shaft opening and gear teeth about its periphery. A cylindrical annular shoulder may extend outwardly from one side of the gear, so that an annular hose-engaging member can be secured around the shoulder. This annular hose-engaging member can be formed with a concave face of the configuration described above to engage the hose. The gear will be formed of a rigid material, e.g., metal, and the hose-engaging member may be formed of a flexible material.

Power from an electric motor is transferred to the drive roller through one or more transmission gears connecting the motor shaft to the roller. For example, a worm gear can be positioned between the worm gear and one of the drive roll gears. The gear teeth of one drive roll gear can then mesh with the gear teeth of the other drive roll gear, so that power is transferred to both rollers. Since the roll gears are interconnected and since the rollers have the same diameter, the roll faces will turn at the same surface speed.

Several optional features can be included in the above drive assembly. For example, a pivotal mount can be used to support one to the drive roller, so that the roll can be pivoted from its hose engaging position to a hose release position in the event of a malfunction. A mount release lever can be used to normally hold the roll in the hose engaging position. Also, the electrical circuitry can include a switch to open the circuit when torque on the motor exceeds a predetermined value, e.g. when the hose becomes jammed. An embodiment of an inexpensive torque release switch actuated by a moveable motor is illustrated in the description of the preferred embodiment.

Hose guides are also provided with each guide having a hose receiving orifice or channel. The orifices lie in spaced parallel planes, and are axially aligned, so that a pathway is defined along the axis of the orifices. The nip of the rollers is also axially aligned along this pathway, so that a hose is carried in a straight line through the guides and nip.

DETAILED DESCRIPTION OF THE INVENTION

Figure 1:
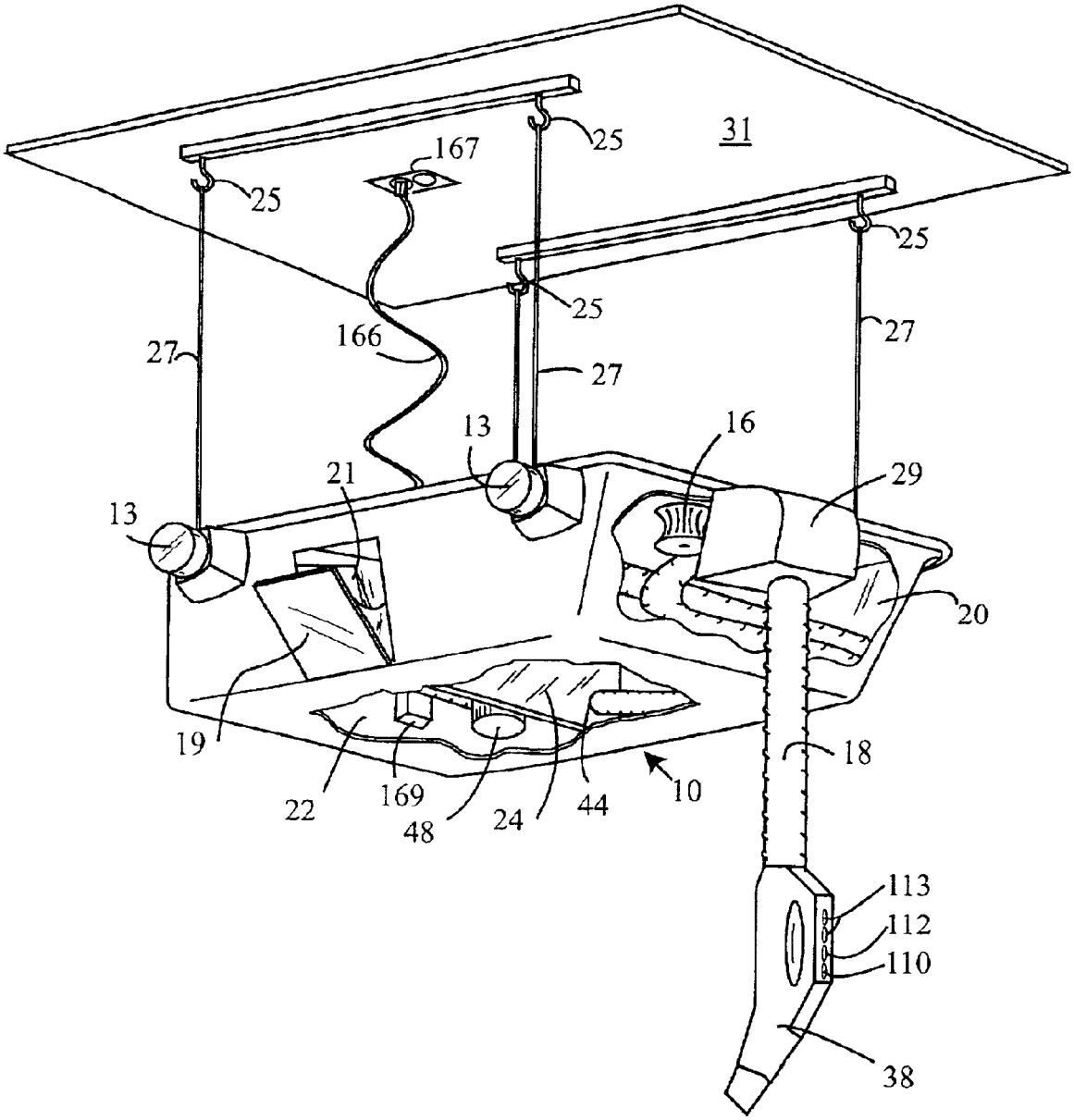
FIG. 1 is a perspective view of one embodiment of the vacuum system of the invention, including the housing lowering mechanism and hose drive assembly.
Figure 2:
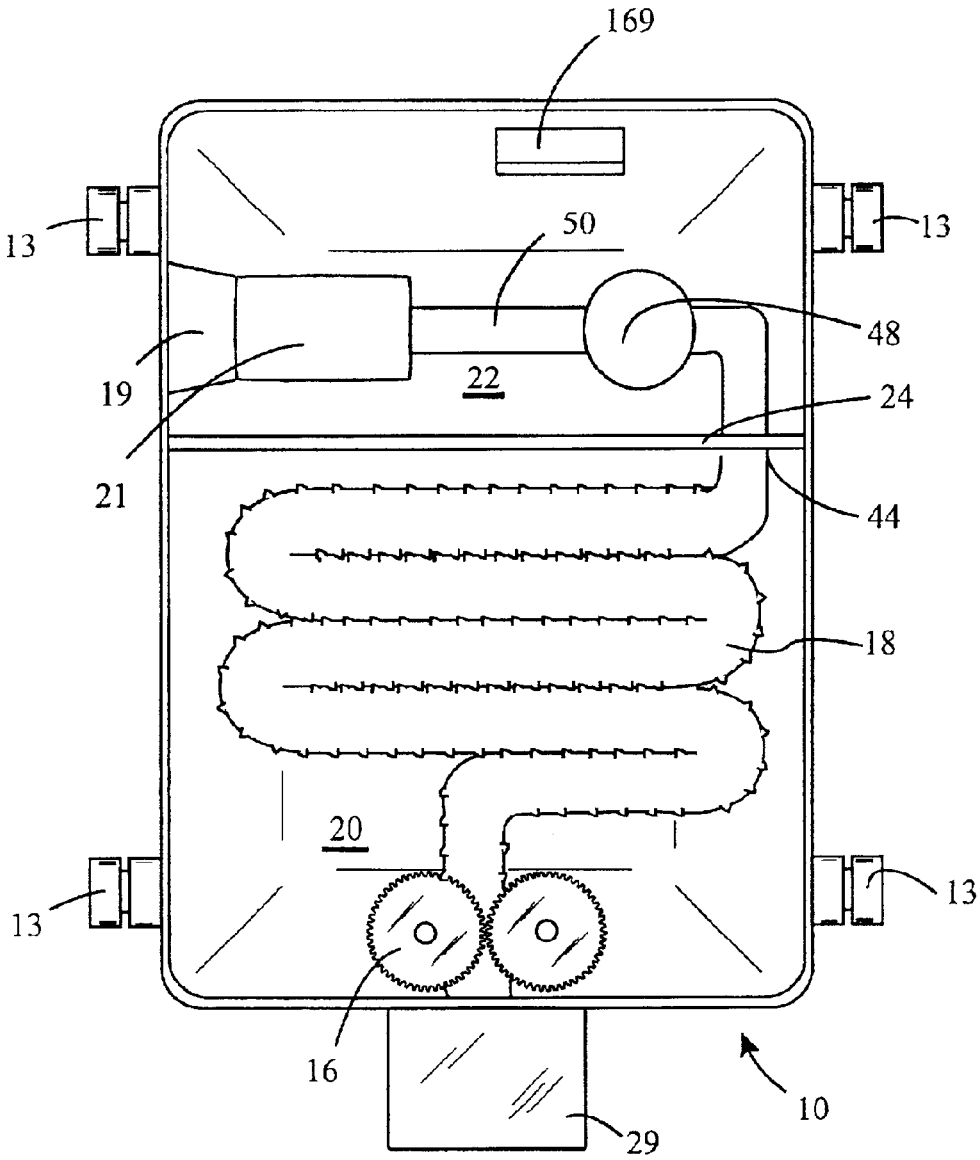
FIG. 2 is a top view of FIG. 1.
Figure 4:
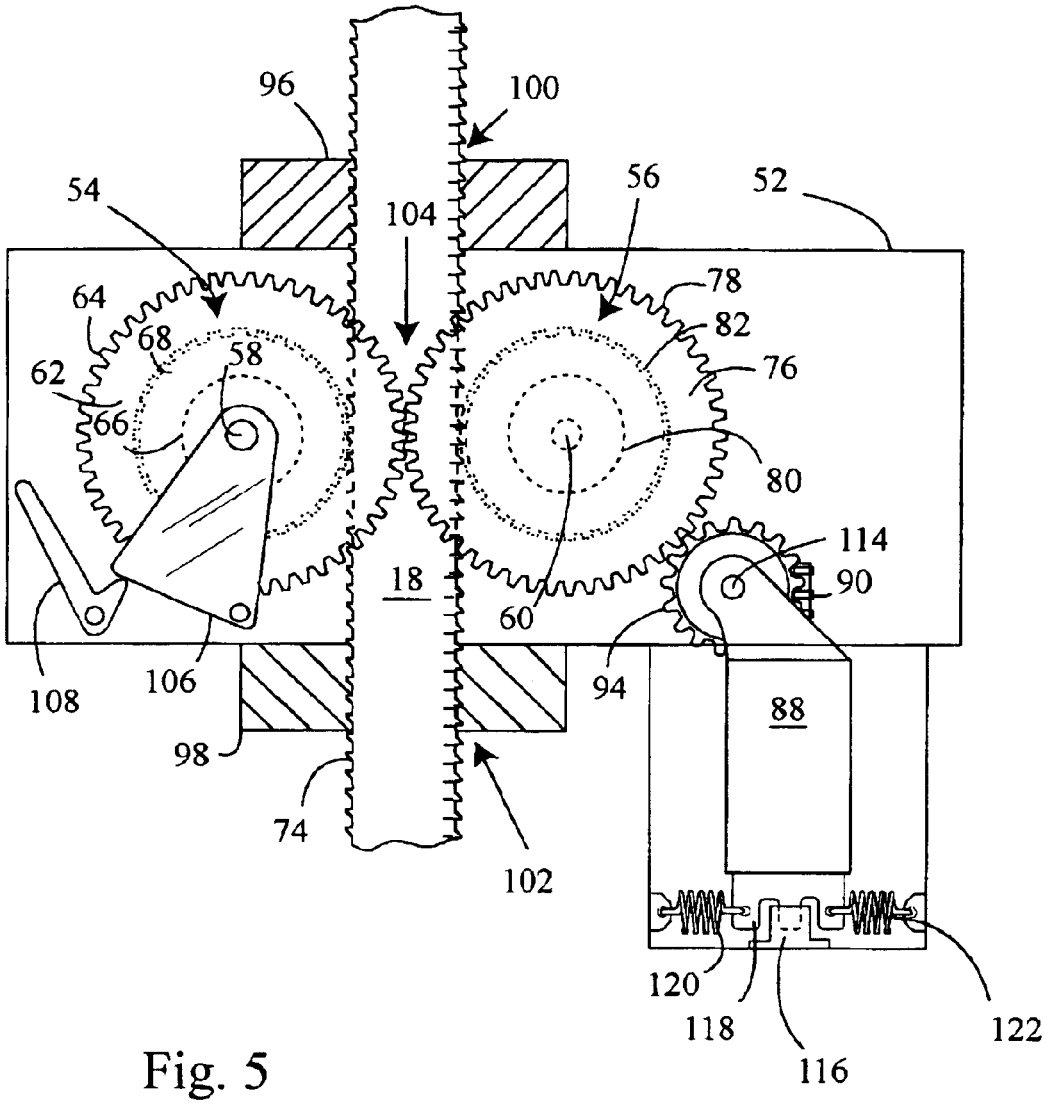
FIG. 4 is a detailed view of the hose drive assembly.
Figure 5:
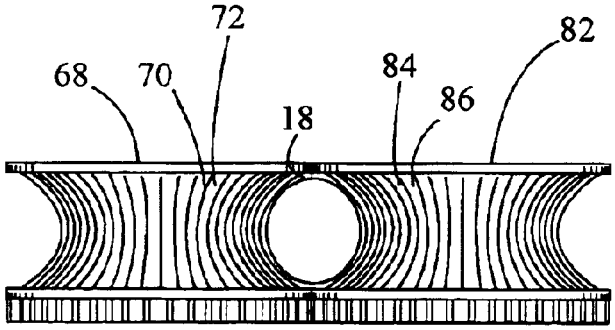
FIG. 5 is a frontal view of the rollers of the drive assembly.

As best shown in FIGS. 1 and 2, a preferred embodiment of the present invention is comprised of housing, generally 10, hanging from a ceiling mounting plate 31 by hooks 25 and cables 27. A hose drive assembly 16, shown in detail in FIGS. 4 and 5, is positioned within housing 10 to withdraw and return a vacuum hose 18. A hose guide 29 directs hose 18 into and out of housing 10.

Housing 10 is comprised of a forward compartment 20, and a rearward compartment 22, separated by a divider wall 24. A hinged debris collector access door 19 opens to allow easy removal or installation of debris collector 21. Motorized pulleys 13 attached to housing 10 raise or lower housing 10 by spooling or unspooling cables 27. A portion of hose 18 terminating with handle 38 hangs below hose guide 29.

Electrical power for the entire vacuum system is delivered from electrical outlet 167 through power cord 166 to distribution box 169. The circuitry associated with box 169 is shown in detail in FIG. 6.

An array of switches located on the grip of handle 38 direct electrical power flow within the system. Switch 110 activates and deactivates hose drive assembly 16 as well as selects the direction of travel for hose 18. Switch 112 energizes and de-energizes vacuum source 48. Switch 113 energizes and de-energizes motorized pulleys 13 as well as selects the direction of rotation of pulleys 13 resulting in the raising or lowering of housing 10.

Figure 3:
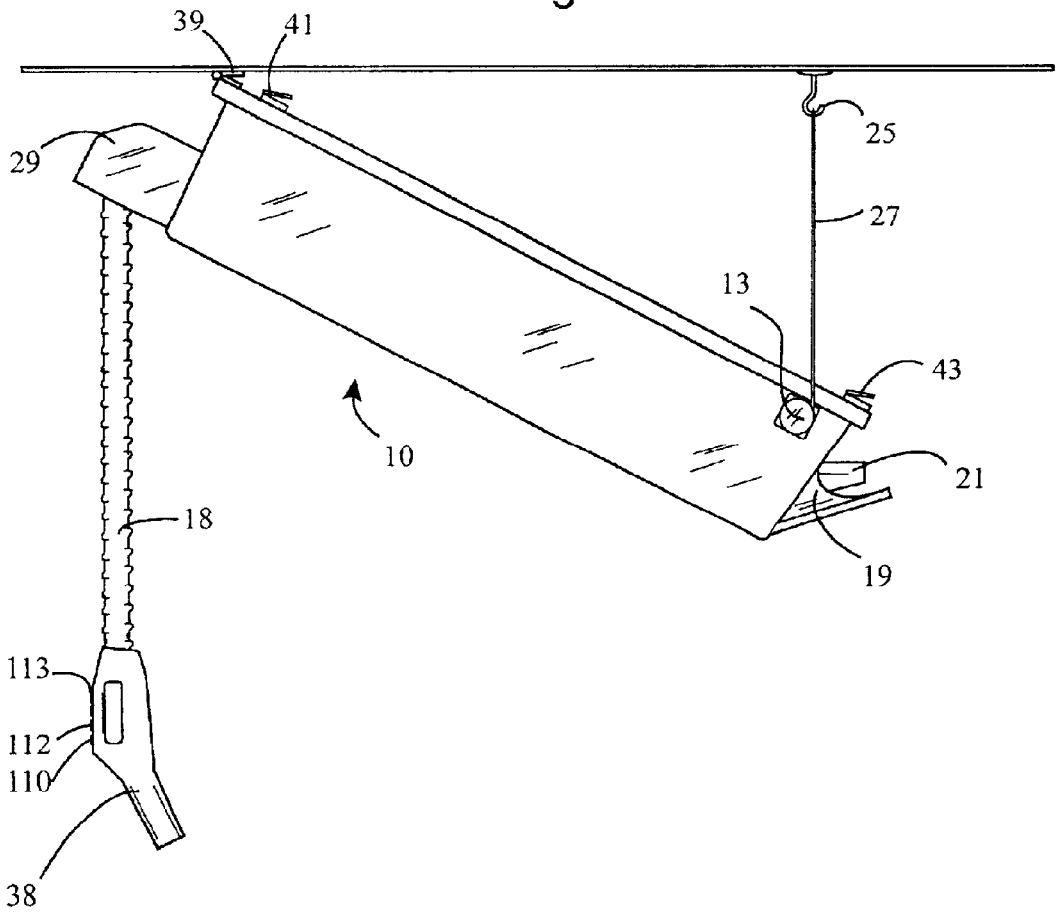
FIG. 3 is a side view of another embodiment showing one end of the vacuum system hinged to the ceiling.

Providing that the ceiling of a structure is low enough to put user maintainable parts within reach while having only one end of the housing lowered, another embodiment of the present invention is available. FIG. 3 depicts this other embodiment in which the front wall of housing 10 is permanently attached to the ceiling of a structure by a hinge 39. A single motorized pulley 13 fixed to the outside of one sidewall near a corner of the rearward section is fastened to at least one cable 27 attached to a single hook 25. Hook 25 is fastened into the ceiling of the structure from a point on the ceiling nearly directly over pulley 13.

A hose guide 29 located flush with the bottom of the front wall of housing 10 guides hose 18 and handle 38 to hang downwardly within reach of the user. The access door 19 hinged into the rear wall of housing 10 allows access to the debris collector 21. Similar to the embodiment of FIGS. 1 and 2, switches 110, 112 and 113 route power flow throughout the system. A minor difference with this embodiment is that switch 113 switches power to only to a single motorized pulley 13. Optionally, two limit switches 41 and 43 can be wired within the current path of motorized pulley 13 such that they interrupt current to motorized pulley 13 once position limits are reached. Limit switch 41 located on the top wall of the housing near hinge 39 is normally closed when the rear of housing 10 is between the raised and lowered position. However, once housing rotates about the axis of hinge 39 lowering the rear of housing 10 within a predetermined distance below the ceiling, normally closed limit switch 41 opens de-energizing motorized pulley 13. At this point, switch 113 will allow current to flow through motorized pulley 13 only in a direction that winds cable 27 onto the spool of pulley 13 rotating housing 10 in an upward direction. Limit switch 43 is normally closed when the rear of housing 10 is between the predetermined lowered position and the raised position flush with the ceiling. However, as the rear of the housing approaches the ceiling, limit switch 43 begins to open and is fully open just as the top edge of the rear of the housing becomes flush with the ceiling interrupting the flow of current to motorized pulley 13 stopping any further upward movement.

As best shown in FIG. 4, hose drive assembly 16 is comprised of a housing 52 enclosing first and second opposed hose drive rollers 54 and 56 supported on parallel shafts 58 and 60, respectively, so that the outer edges of their hose engaging surfaces face each other at a predetermined distance. Roller 54 is formed of a gear 62 having gear teeth 64 about its periphery, and a cylindrical annular shoulder 66 that extends outwardly from one side about shaft 58. An annular hose-engaging member 68 is secured around shoulder 66. Member 68 can be formed with a concave face 70, having transverse hose engaging projections 72 equally spaced around its periphery. Projections 72 may be integrally formed with member 68, and are adapted to fit within valleys 74 on hose 18. In the event hose 18 becomes slightly unsynchronized, or if valleys 74 are slightly less than equally spaced, projections 72 will flex upon engagement with hose 18 to adjust for the difference.

Roller 56 is similarly constructed of gear 76 having gear teeth 78 about its periphery, and a cylindrical annular shoulder 80 extending outwardly from one side of gear 76 about shaft 60. An annular hose-engaging member 82, secured around shoulder 80, includes concave face 84, with transverse hose engaging projections 86 equally spaced around its periphery.

Rollers 54 and 56 are driven by electric motor 88 communicating with gears 62 and 76 by way of worm gear 90 and transfer gear 94. Motor 88 is wired into an electrical circuit so that gear 90 can be rotated in either direction to reversibly rotate rollers 54 and 56 in opposite directions.

Spaced hose guides 96 and 98 are positioned on either side of rollers 54 and 56 and include orifices 100 and 102, respectively, positioned along a vertical pathway extending through the center of nip 104 to accurately position hose 18. As shown, guides 100 and 102 are made of a smooth non-abrasive material, such as nylon. However, the guides can also be made of metal, or can be in the form of idler rollers.

Drive roller 54 is supported on a pivotal mount 106 so that roller 54 can be pivoted from its hose engaging position to a hose release position in the event of a malfunction. Release lever 108 normally holds roller 54 in the hose engaging position.

Figure 6:
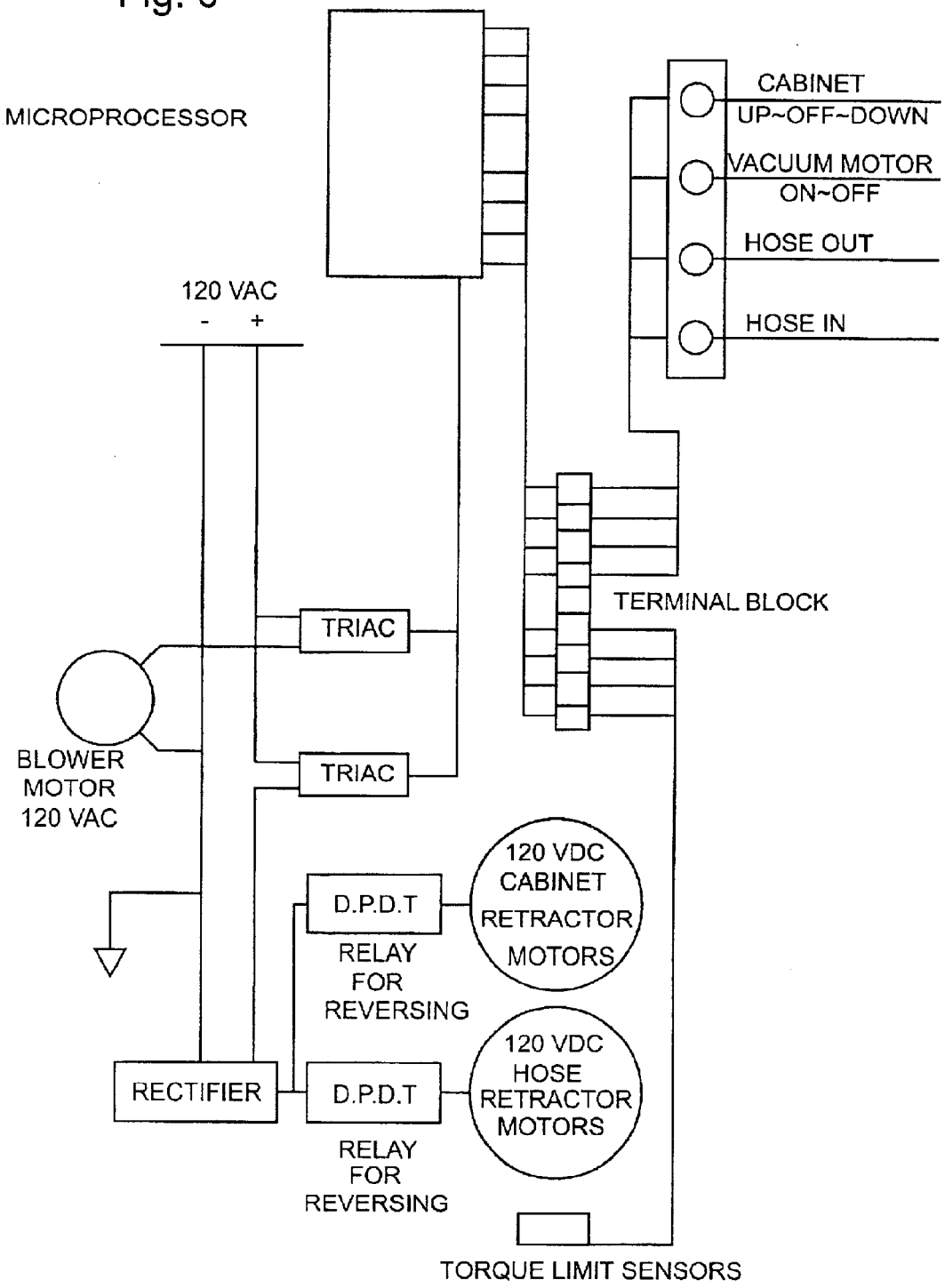
FIG. 6 is a schematic of the electrical circuitry of the invention.

An electrical circuit, shown schematically in FIG. 6, joins motor 88 to drive control switch 110 in handle 38. Switch 110 includes forward, off and back positions, so that the operator can activate the drive assembly to extend or retract hose 18. In addition, the circuitry includes a switch 112 to activate suction device 48.

Motor 88 is pivotally mounted on transfer gear shaft 114. In the event that the gearing jams, e.g., as a result of binding of hose 18, gear 78 will remain stationary, while gears 90 and 94 will continue to turn. As a result, motor 88 will be caused to pivot about shaft 114. A sensor switch 116 is also positioned in the electrical circuitry including motor 88. Switch 116 is of the type that emits a light that is reflected back to the sensor, and remains closed as long as light is reflected. A reflected flag 118 is mounted on the bottom of motor 88 and normally reflects light back to sensor 116. However, when there is a malfunction, causing motor 88 to pivot from its normal position, flag 118 is moved out of position, opening switch 116. When the malfunction is corrected, motor 88 is urged back to its normal position by springs 120 and 122.

In operation, hose 18 is positioned in compartment 22 with its inner end connected to outlet 46 and its upper end, carrying handle 38 extending into compartment 20. Hose 18 extends along a pathway through guide 98, nip 104 and guide 96. When the vacuum system is to be used, the operator reaches up and grasps handle 38 and moves switch 10 to its forward position, causing motor 88 to rotate rollers 54 and 56 so that their inner faces move toward compartment 22. Members 68 and 82 firmly engage the outer surface of hose 18 with projections 72 and 86 extending into valleys 74, withdrawing hose 18 from compartment 22 and deploying hose 18 from compartment 22 and deploying hose through compartment 20 out of the housing. When hose 18 has been deployed to the desired length, the operator moves switch 110 to its off position. The operator then moves switch 112 to the on position to begin vacuuming.

When vacuuming is completed, the operator moves switch 112 to the off position, and moves switch 110 to its back position, causing motor 88 to rotate rollers 54 and 56 in the opposite direction so that their inner faces move away from compartment 20, returning hose 18 into its stored position in compartment 22.

Figure 7:
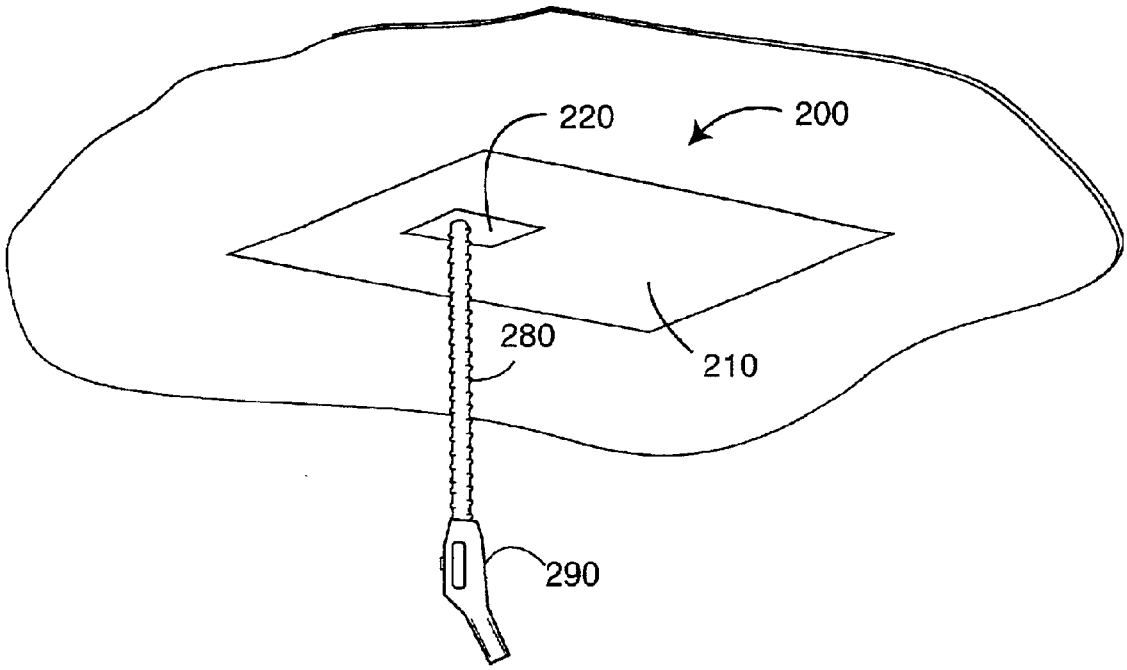
FIG. 7 is a perspective view of an embodiment of the vacuum system flush mounted to the ceiling of a building.

FIG. 7 shows yet another embodiment of a ceiling mounted vacuum system generally 200 having a bottom surface 210 mounted to the ceiling of a building. Bottom surface 210 is in a plane flush with the ceiling. A hose guide 220 provides an exit for a vacuum hose 280 and handle 290.

Figure 8:
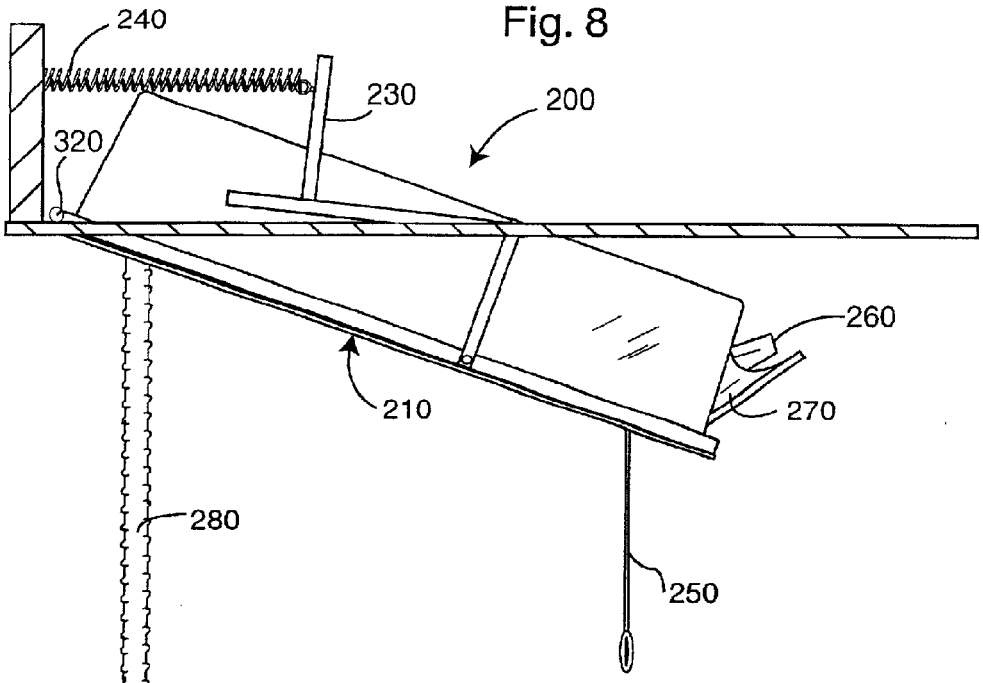
FIG. 8 is a side view of the ceiling mounted vacuum system having a spring mechanism to facilitate manual positioning.
Figure 8:
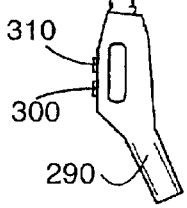

FIG. 8 depicts a side view of the embodiment showing a positioning means 230 incorporating at least one spring 240 for facilitating manual positioning of the vacuum system. A pull string 250 is provided so that a user can lower the vacuum system to allow access to a vacuum bag 260 by opening an access door 270. The hose 280 hanging below surface 210 ends with a handle 290. System 200 uses the hose drive mechanism shown in FIG. 4 to extend and retract hose 280. Two switches 300 and 310 located on handle 290 control power flow to the vacuum system's vacuum source and hose drive mechanism respectively. A hinge 320 connects one end of lower surface 210 to the ceiling.

Figure 9:
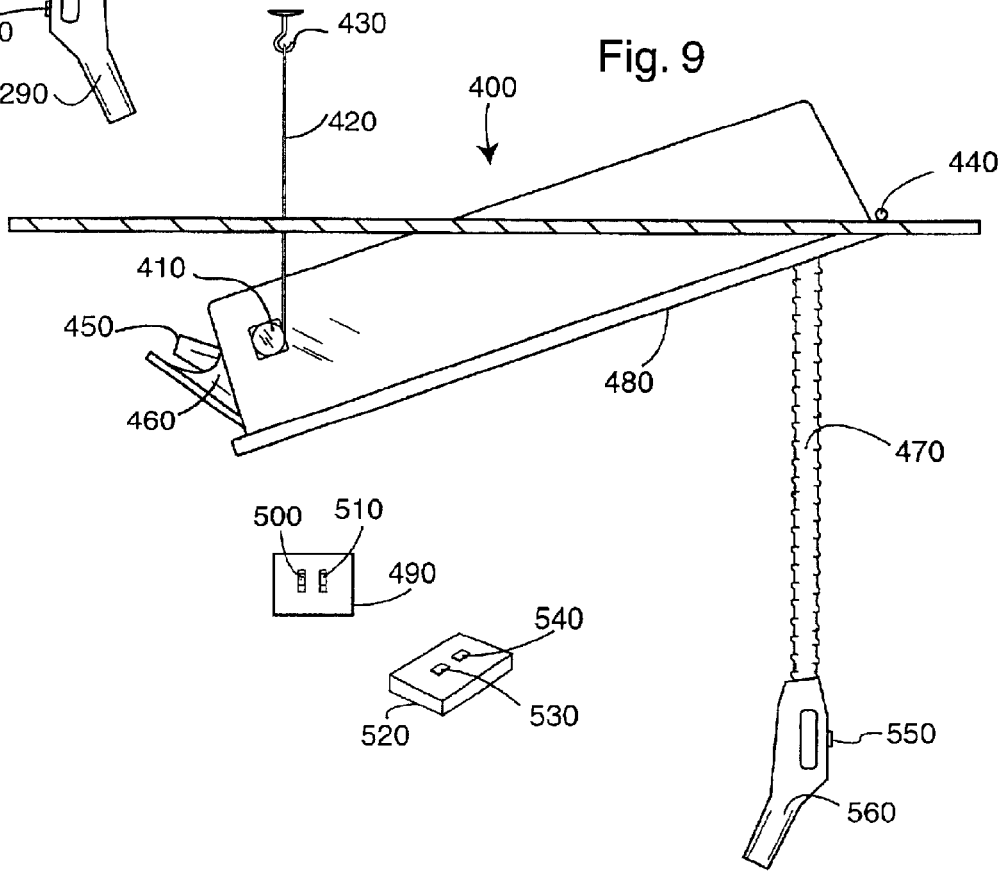
FIG. 9 is a side view of the ceiling mounted vacuum system using the positioning mechanism of FIG. 3 further including optional wall switches or hand held remote.

FIG. 9 shows still another embodiment of the flush ceiling mounted vacuum system, generally 400 that uses a positioning means similar to that of FIG. 3. A motorized pulley 410, a cable 420, an attic-mounting hook 430 and hinge 440 forming the positioning means, is provided so that a user can lower the vacuum system to allow access to a vacuum bag 450 by opening an access door 460. A hose 470 hanging below a lower surface 480, ends with a handle 560 that includes a switch 550 to control power flow to the vacuum system's vacuum source. Lower surface 480 of system 400 lies in a plane flush with the ceiling of a building when system 400 is in a raised position. A wall switch panel 490 having switches 500 and 510 is provided for activating the positioning system and the hose drive mechanism shown in FIG. 4. An optional hand held remote control 520 having switches 530 and 540 is optionally provided for activating the positioning system and hose drive mechanism respectively.

Certain modifications and improvements will occur to those skilled in the art upon a reading of the foregoing description. For example, the positioning means for raising and lowering the vacuum system housing could be realized with a mechanical linear actuator of the ball screw type or by pneumatic cylinders and other similar positioners without deviating from the scope of the invention. It should be understood that all such modifications and improvements have been deleted herein for the sake of conciseness and readability but are properly within the scope of the following claims.

What is claimed is:

1. A self-contained vacuum system comprising:

a) a housing attachable to the ceiling of a building;

b) a positioning means for moving said housing between a raised position and a lowered position;

c) a vacuum hose having an inner end within said housing and a distal end external said housing; and d) a control means for activating said positioning means.

2. The system of claim 1, wherein said positioning means comprises at least one motorized pulley attached to said housing and at least one cable with first and second ends for attaching said housing to the ceiling.

3. The system of claim 2, wherein said first end of said at least one cable is attachable to the ceiling and said second end of at least one cable is attachable to said at least one motorized pulley.

4. The system of claim 1, wherein said control means is at least one switch on said hose distal end.

5. The system of claim 1, further including a debris collector and a vacuum source mounted within said housing, said hose inner end communicating with said debris collector and said vacuum source communicating with said debris collector.

6. The system of claim 1, further including a reversible drive means within said housing to move said hose between an extended position from said housing and a retracted position within said housing.

7. The system of claim 1, including a debris collector access door within said housing.

8. The system of claim 1, including a hinge on an end of said housing for attaching said end of said housing to the ceiling.

9. A self-contained vacuum system comprising:

a) a housing attachable to the ceiling of a building;

b) a positioning means to move said housing between a raised position and a lowered position;

c) a vacuum hose having an inner end and a distal end, said hose extendable between a retracted position in said housing, and an extended position extending from said housing;

d) a handle connected to said distal end of said hose;

e) a control means for activating said positioning means;

f) a reversible drive means to move said hose between said retracted and extended positions;

g) a debris collector mounted in said housing, said inner end communicating with said debris collector; and h) a vacuum source within said housing in communication with said debris collector.

10. The system of claim 9, wherein said reversible drive means is mounted within said housing.

11. The system of claim 9, wherein said control means comprises an array of switches on said handle, at least one of said switches for controlling said reversible drive means and at least one of said switches for controlling said positioning means and at least one of said switches for controlling power to said vacuum source.

12. The system of claim 9, wherein said housing includes a filter bag access door opening into said housing.

13. The access door of claim 12, wherein said access door is hinged to said housing.

14. A vacuum system attachable to the ceiling of a structure comprising:

a) a housing attachable to the ceiling of a building having a hose storage compartment and a vacuum source compartment;

b) a positioning means to move said housing between a raised position and a lowered position;

c) a vacuum hose having a distal end extendable between a retracted position in said hose storage compartment, and an extended position extending from said hose storage compartment;

d) a control means on said hose for activating said positioning means;

e) a reversible drive means mounted in said hose storage compartment to move said hose between said retracted and extended positions;

f) a debris collector mounted in said vacuum source compartment, said hose having an inner end communicating with said debris collector; and g) a vacuum source mounted in said vacuum source compartment, said source communicating with said debris collector.

15. The system of claim 14, wherein a divider wall separates said vacuum source compartment and said hose storage compartment.

16. The system of claim 14, wherein said positioning means comprises at least one motorized pulley attached to said housing and at least one cable having a ceiling attachment end and a pulley attachment end.

17. The system of claim 14, wherein said debris collector is a disposable filter bag held within said housing.

18. The system of claim 14, wherein said control means is a control handle at the distal end of said hose, said control handle includes switches for controlling said reversible drive means and for controlling said positioning means and for switching power to said vacuum source.

19. The system of claim 14, wherein an end of said housing adjacent to said hose storage compartment includes a hinge attachable to the ceiling.

20. The system of claim 14, wherein an end of said housing adjacent to said vacuum source compartment includes a filter bag access door.

21. A self-contained vacuum system comprising:

a) a housing having a bottom surface, said bottom surface mountable in a plane flush with the ceiling of a building;

b) a positioning means for moving said housing between a raised position and lowered position;

c) a vacuum hose extendable between a retracted position in said ceiling and an extended position extending downward from said ceiling; and d) a reversible drive means mounted in said housing to move said hose between said retracted and extended positions.

22. The self-contained vacuum system of claim 21, further including wall switches for activating said positioning means and said reversible drive means.

23. The self-contained vacuum system of claim 21, further including a hand held remote control for activating said positioning means and said reversible drive means.

24. The self-contained vacuum system of claim 21, wherein said positioning means is at least one spring for facilitating the manual positioning of said housing between said raised position and said lowered position.

25. The self-contained vacuum system of claim 21, wherein said housing further includes a hinged end attached to the ceiling.

* * * * *